US008023845B2

(12) United States Patent
Inoue

(10) Patent No.: US 8,023,845 B2
(45) Date of Patent: Sep. 20, 2011

(54) IMAGE FORMING APPARATUS WITH A CONTROL UNIT THAT CONTROLS A CHARGING BIAS VOLTAGE

(75) Inventor: Ryo Inoue, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 593 days.

(21) Appl. No.: 11/939,951

(22) Filed: Nov. 14, 2007

(65) Prior Publication Data

US 2008/0118258 A1 May 22, 2008

(30) Foreign Application Priority Data

Nov. 20, 2006 (JP) ..... 2006-312685

(51) Int. Cl.
*G03G 15/02* (2006.01)

(52) U.S. Cl. ..... 399/50

(58) Field of Classification Search ..... 399/50, 399/89

See application file for complete search history.

(56) References Cited

U.S. PATENT DOCUMENTS

| | | | | |
|---|---|---|---|---|
| 5,596,393 | A | 1/1997 | Kobayashi et al. | 399/174 |
| 5,809,379 | A | 9/1998 | Yano et al. | 399/159 |
| 6,101,343 | A * | 8/2000 | Satoh et al. | 399/50 |
| 6,560,419 | B2 * | 5/2003 | Sugiura | 399/50 |
| 7,054,574 | B2 | 5/2006 | Facci et al. | 399/89 |
| 7,113,726 | B2 * | 9/2006 | Tokumasu et al. | 399/176 |
| 2002/0102108 | A1 * | 8/2002 | Adachi et al. | 399/50 |
| 2006/0140660 | A1 | 6/2006 | Facci et al. | 399/89 |
| 2006/0222406 | A1 * | 10/2006 | Facci | 399/168 |

FOREIGN PATENT DOCUMENTS

| | | | |
|---|---|---|---|
| JP | 03101765 | A * | 4/1991 |
| JP | 5-289470 | | 11/1993 |
| JP | 5-297685 | | 11/1993 |
| JP | 6-003921 | | 1/1994 |
| JP | 6-161214 | | 6/1994 |
| JP | 6-242663 | | 9/1994 |
| JP | 2000-330362 | | 11/2000 |
| JP | 2005-157355 | | 6/2005 |

* cited by examiner

*Primary Examiner* — David Gray
*Assistant Examiner* — Billy J Lactaoen
(74) *Attorney, Agent, or Firm* — Fitzpatrick, Cella, Harper & Scinto

(57) ABSTRACT

An image forming apparatus includes a movable image bearing member; charging means for electrically charging the image bearing member; voltage applying means for applying to the charging means an oscillating voltage including an oscillating component and a constant component in one cycle; discharging means for selectively discharging an electrically charged surface of the image bearing member to form an electrostatic latent image; and changing means for changing an application time of the constant component during the one cycle depending on a spatial frequency, with respect to a movement direction of the image bearing member, of the electrostatic latent image to be formed.

3 Claims, 5 Drawing Sheets

IMAGE FORMING APPARATUS WITH A CONTROL UNIT THAT CONTROLS A CHARGING BIAS VOLTAGE

FIELD OF THE INVENTION AND RELATED ART

The present invention relates to an image forming apparatus such as a printer, a copying machine, or a facsimile apparatus. More specifically, the present invention relates to an image forming apparatus of an indirect (transfer) type or a direct type in which a desired image is formed and borne with respect to an image bearing member such as an electrophotographic photosensitive member or an electrostatic recording dielectric member and particularly, in which an electrostatic latent image is formed on the image bearing member with a light beam.

In an image forming apparatus in which image formation is performed by forming an electrostatic latent image, through light beam exposure (digital exposure), on a surface of an image bearing member electrically charged by contact charging means or contact injection charging means for applying a voltage having an AC component, a defective image which is called a "moire" can be caused.

In contact charging in which an AC bias is applied, a minute change in charge potential is caused depending on the period of the AC bias, so that density non-uniformity is observed on an image but a higher spatial frequency is ordinarily set so that the density non-uniformity is not noticeable. Further, a change in density is also small, so that the change does not lead to a deterioration in image quality.

However, when the spatial frequency of the density non-uniformity on the image due to the contact charging and the spatial frequency of the image interfere with each other, a defective image may be produced when an output image with a large change in density is produced and a stripe-like density non-uniformity at a spatial frequency is liable to be noticeable, i.e., a so-called "moire". This phenomenon occurs in the case where the image has a repeated darkness (bright and dark) pattern with a constant periodicity, such as a screen pattern. The density non-uniformity due to the charging occurs in a rotational direction of the image bearing member, so that in the case of taking interference with the density non-uniformity into consideration, the image has a problem with respect to the spatial frequency of darkness in a direction identical to the rotational direction of the image bearing member, i.e., in a sub-scan direction. Here, the spatial frequency of darkness in the sub-scan direction (referred to as a "spatial frequency in the sub-scan direction") is defined as the number of repetition of a darkness (bright and dark) pattern per unit length in the sub-scan direction. A unit of the spatial frequency in the sub-scan direction is lines/mm. For example, when the number of screen lines per inch is 200 1pi and the direction of a screen pattern (extension of screen lines) is perpendicular to the sub-scan direction, the spatial frequency in sub-scan direction is 7.87 lines/mm. When the direction of the screen pattern is inclined 45 degrees with respect to the sub-scan direction, the spatial frequency in the sub-scan direction is 5.57 lines/mm.

Here, an occurrence condition of the moire can be represented by the following formula:

$$Fd \times Vp \approx fp,$$

wherein Fd represents a spatial frequency (lines/mm) in the sub-scan direction (rotational direction of image bearing member) of an image, Vp represents a surface moving speed (mm/sec) as a process speed of a photosensitive drum, and fp is a frequency (Hz) of an AC bias applied to a charging member.

When the frequency of the AC bias applied to the charging member is set so as not to satisfy the above described formula (condition), the moire does not occur.

In order to prevent the occurrence of the moire, measures such that the charge frequency fp is sufficiently increased with respect to Fd×Vp can be considered but undesirably lead to the problem of increased charging noise, depending on the frequency.

Further, in order to prevent or suppress the occurrence of the moire, a change in frequency of an oscillating voltage by selecting an oscillation circuit depending on the process speed (=Vp) and the resolution (=d) has been proposed in Japanese Laid-Open Patent Application (JP-A) Nos. Hei 6-161214 and 2000-330362.

JP-A Hei 5-297685 has proposed a random change in frequency every one cycle during charging.

JP-A Hei 5-289470 has proposed the application of a superposed bias of AC+DC, randomly changed in frequency every one cycle, to a charging roller.

JP-A Hei 6-242663 has proposed the application of a superposed bias of AC+DC, and a change in frequency, to a charging roller.

JP-A 2005-157355 has proposed superposition of DC+AC of a burst modification type in which the application time of a DC voltage is increased by stopping an AC voltage every one period and is applied to a charging roller in order to prolong the lifetime of an OPC drum by stabilizing charging.

However, in a method of providing an output substrate of an AC bias different in frequency or preparing a high voltage source for exactly outputting a plurality of frequencies, not only are available resolutions are limited, but also the apparatus cost and size are undesirably increased.

Further, a high voltage source mounted to an ordinary image forming apparatus is optimized so as to accurately output an AC waveform having a specific frequency, so that the waveform is changed in a method of changing a frequency when the frequency is changed, thus resulting in a lowering in charging power in some cases.

SUMMARY OF THE INVENTION

The present invention has been developed in view of the above described problems.

A principal object of the present invention is to prevent the occurrence of image moire caused by interference of an AC bias with a latent image pattern even in a constitution in which a high voltage source generates a waveform with a constant frequency.

According to an aspect of the present invention, there is provided an image forming apparatus comprising:

a movable image bearing member;

charging means for electrically charging the image bearing member;

voltage applying means for applying to the charging means an oscillating voltage including an oscillating component and a constant component in one cycle;

discharging means for selectively discharging an electrically charged surface of the image bearing member to form an electrostatic latent image; and changing means for changing the application time of the constant component during the one cycle depending on a spatial frequency, with respect to a movement direction of the image bearing member, of the electrostatic latent image to be formed.

According to another aspect of the present invention, there is provided an image forming apparatus comprising:

a movable image bearing member;

charging means for electrically charging the image bearing member;

voltage applying means for applying to the charging means an oscillating voltage including an oscillating component and a constant component in one cycle;

discharging means for selectively discharging an electrically charged surface of the image bearing member to form an electrostatic latent image; and changing means for non-periodically changing an application time of the constant component during the one cycle.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Embodiment 1

(1) Image Forming Portion

Figure 1:
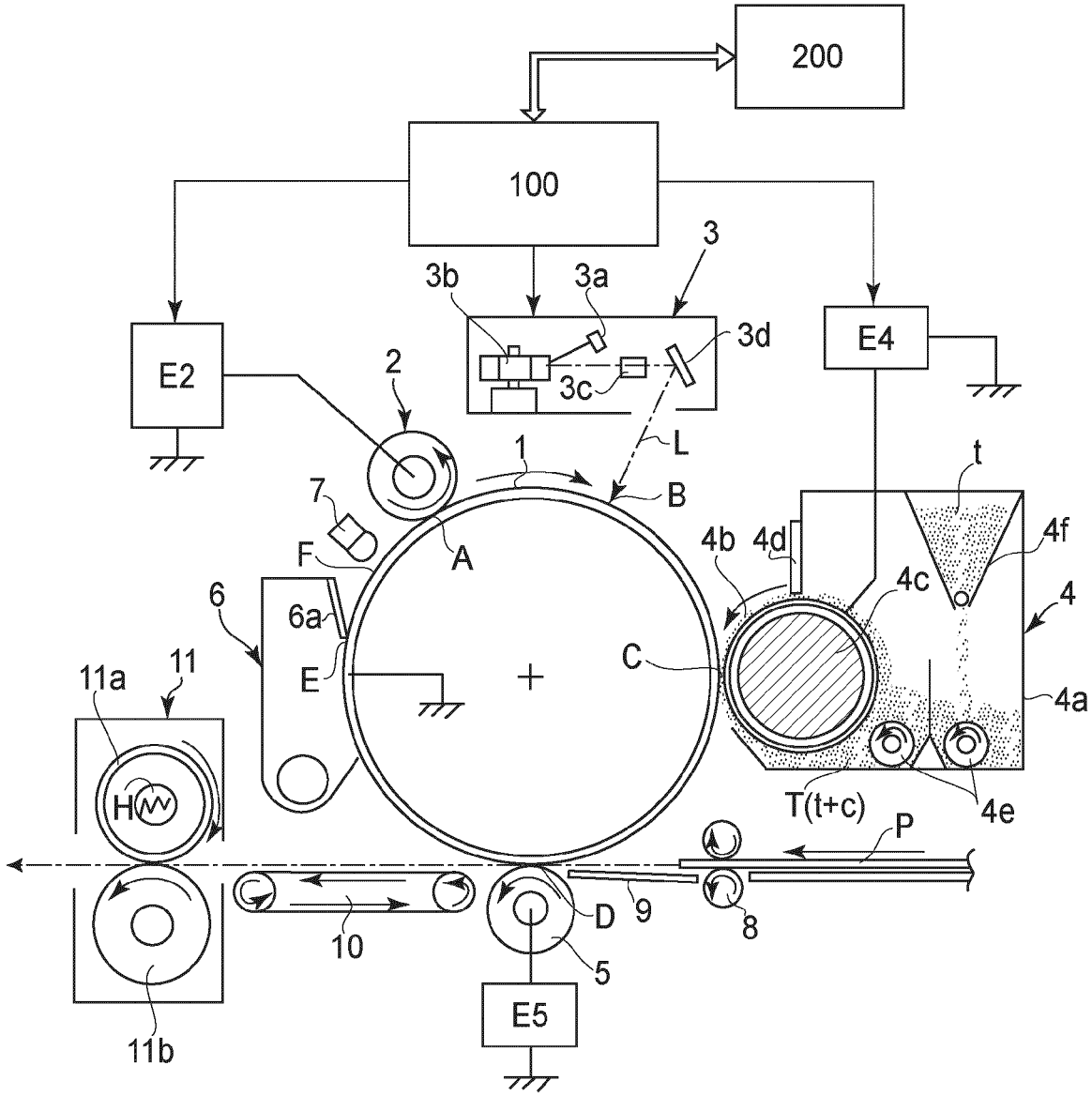
FIG. 1 is a schematic view of an image forming apparatus of Embodiment 1.

FIG. 1 is a schematic view showing a schematic mechanism of an image forming apparatus in this embodiment. This image forming apparatus is a transfer type electrophotographic laser printer and forms on a sheet-like recording material P an image corresponding to electrical image signal inputted from a host apparatus 200 connected to a main assembly control portion (CPU) 100, thus outputting the image formed on the recording material P. The host apparatus 200 is a personal computer, an image reader, a facsimile apparatus, etc.

The main assembly control circuit portion 100 effects giving and receiving of various electrical information signals with the host apparatus 200. Further, the control circuit portion 100 effects processing of electrical information signals inputted from various process equipment and sensors of an image forming portion processing of electrical command signals sent to various process equipment and the like, and control of a predetermined image forming sequence. This control is executed in accordance with a control program or a reference table stored in an ROM.

The printer includes an electrophotographic photosensitive drum 1 as a movable image bearing member. In this embodiment, this drum includes an aluminum cylinder having a diameter of 60 mm and a negatively chargeable organic photosensitive layer applied onto an outer peripheral surface of the aluminum cylinder and is rotationally driven about a drum axis at a process speed of 250 mm/sec by an unshown driving means.

The peripheral surface of this rotating drum 1 is electrically charged substantially uniformly to a predetermined polarity and a predetermined potential in a charging nip A by a charging roller 2 disposed as a charging means in contact with the drum 1.

In this embodiment, the charging roller 2 includes a core metal, an electroconductive elastic layer of EPDM (ethylenepropylene-diene monomer) rubber integrally formed around and concentrically with the core metal, and an urethane rubber layer which is formed at an outer peripheral surface of the electroconductive elastic layer and contains carbon black dispersed in the urethane rubber layer so as to have a volume resistivity of $10^5$ ohm.cm. This charging roller 2 is disposed substantially parallel to the drum 1 and is substantially uniformly brought into contact with the drum 1 at each of portions extending in a longitudinal direction of the charging roller 2 to form the charging nip A with the drum 1. The charging roller 2 is rotatably held by a bearing member at both end portions thereof and is rotated by the rotation of the drum 1. As a material for the electroconductive elastic layer, it is also possible to use NBR, silicone rubber, etc., other than EPDM rubber.

A charging bias generating portion E2 is a voltage application means for applying a voltage to the charging roller 2. From this charging bias generating portion E2, a charging bias controlled as described later is applied to the core metal of the charging roller 2 rotated by the rotation of the drum 1, so that the peripheral surface of the rotating drum 1 is electrically charged uniformly to the predetermined polarity and potential. In this embodiment, the drum surface is substantially uniformly charged to a predetermined negative potential.

The thus uniformly charged surface of the drum 1 is subjected to scanning exposure with a light beam (laser beam) L which is outputted from a laser scanner 3 as an image exposure device and is modulated corresponding to an image signal. By this scanning exposure, a potential at an exposed light portion where the charged drum surface is irradiated with the light beam is attenuated, so that an electrostatic latent image corresponding to scanning image information is formed on a surface of the drum 1. In this embodiment, the laser scanner 3 is discharging means for selectively removing electricity from the charged surface of the drum 1 as the image bearing member.

In this embodiment, an exposure method is an image exposure method in which the drum surface is exposed to light corresponding to an image information portion. The laser scanner 3 includes a semiconductor laser 3*a* for outputting a light beam L modulated corresponding to a time-serial electrical digital signal of image-processed image information inputted from the control circuit portion 100, and includes a rotatable polygonal mirror 3*a*, *f*θ lens 3*c*, a reflecting mirror 3*d*, etc. The light beam L is capable of being changed in exposure amount modulation by a PWM (pulse-width modulation) method. The charged surface of the drum 1 is subjected to main scanning exposure with the outputted light beam with respect to a drum generatrix direction.

By this main scanning exposure and sub-scanning by the drum rotation, an electrostatic latent image corresponding to a scanning exposure pattern is formed at the rotating drum 1 surface. In this embodiment, a scan interval is 600 lpi in terms of an image resolution.

The electrostatic latent image formed on the surface of the drum 1 in the above described manner is visualized (developed) into a toner image at a developing portion C by a developing device 4. In this embodiment, the developing device 4 is a reverse-developing device using two-component developer. The developing device 4 includes a developing container 4*a* containing two-component developer T, a non-magnetic developing sleeve 4*b* rotatably disposed at an opening of the developing container 4*a*, a magnet roller 4*c* nonrotationally disposed and fixed in the developing sleeve 4*b*, a developing blade 4*d* disposed with a predetermined spacing with respect to the developing sleeve 4*b*, developer stirring/conveying screw shafts 4*e* disposed in the developing container 4*a*, and a toner hopper 4*f* containing supplying toner t.

In this embodiment, the developing sleeve 4*b* is a cylinder of 24 mm in diameter and is rotationally driven around the magnet roller 4*c* at a speed of 300 mm/sec in a counterclockwise direction indicated by an arrow. The two-component developer T is a mixture of a negatively chargeable toner (negative toner) t having an average particle size of 8 μm and a positively chargeable magnetic carrier c having an average particle size of 50 μm and has a toner concentration of 5% by weight.

At an outer surface of the rotating developing sleeve 4*b*, the two-component developer T is carried as a magnetic brush layer by a magnetic force of the magnet roller 4*c* in the developing sleeve 4*b*. The magnetic brush layer is conveyed by the rotation of the developing sleeve 4*b* and regulated in thickness by the developing blade 4*d* so as to have a predetermined value, thus being conveyed to a developing portion C facing the drum 1. To the developing sleeve 4*b*, a predetermined developing bias is applied from a developing bias generating portion E4. In this embodiment, the developing bias is in the form of an AC electric field (2 kVpp, 2 kHz) biased with a DC voltage of −500 V. By applying the developing bias, the electrostatic latent image on the drum 1 is developed in a reverse developing manner as a toner image at the developing portion C with the magnetic brush layer of the developer on the developing sleeve 4*b*.

The magnetic brush layer, of the developer on the developing sleeve, contributing to the development of the electrostatic latent image at the developing portion C is conveyed and returned to the inside of the developing container 4*a* by further rotation of the developing sleeve 4*b*. The toner concentration of the two-component developer T in the developing container 4*a* is detected by an unshown optical toner concentration sensor. On the basis of resultant detection information, the supplying toner t is supplied from the toner hopper 4*f* in an appropriate amount with appropriate timing, thus being uniformly stirred and mixed with respect to the two-component developer T by the screw shafts 4*e*. As a result, the toner concentration of the two-component developer T is controlled so as to be kept in a predetermined proper image.

The recording material (transfer material) P is separated and fed one by one from an unshown sheet feeding portion with predetermined timing. The fed recording material P reaches a registration roller pair 8 and is subjected to correction of oblique movement in such a manner that a leading end portion of the recording material P stopped in rotation at that time is stopped by a nip of the registration roller pair 8.

The recording material P is then fed by the registration roller pair 8 rotationally driven with predetermined control timing and is guided by a pre-transfer guide 9 to a transfer nip D as a contact portion between the drum 1 and a transfer roller rotating as a transfer means. The transfer roller 5 includes a core metal and an electroconductive elastic layer integrally formed concentrically around the core metal and is disposed parallel to the drum 1. The transfer roller 5 is pressed against the drum 1, at a predetermined pressing force, against elasticity of the electroconductive elastic layer to form the transfer nip D with the drum 1. The recording material P is conveyed in the transfer nip D during which a transfer bias of a predetermined potential and a polarity (positive polarity in this embodiment) opposite to the charge polarity of the toner t is applied from a transfer bias generating portion E5 to the transfer roller 5. By applying a transfer bias of the polarity opposite to that of the toner to the transfer roller 5, at the transfer nip D, electric charges of a polarity opposite to that of the toner are imparted to a back surface (opposite from the surface facing the drum 1) of the recording material P. As a result, the toner image on the drum 1 side is transferred onto the surface of the recording material P.

The recording material P coming out of the transfer nip D is separated from the surface of the drum 1 and introduced into a fixing device 11 by a conveying device 10, thus being subjected to fixation of an unfixed toner image on the recording material P in the fixing device 11. The fixing device 11 in this embodiment is a hot roller-type device comprising a heating roller 11*a* containing a halogen heater H and temperature-controlled at a predetermined fixing temperature at its surface and a pressing roller lib disposed substantially parallel to the heating roller 11*a* so as to form a fixing nip with the heating roller 11*a* by press-contact with the heating roller 11*a*. The heating roller 11*a* and the pressing roller lib are rotationally driven at a predetermined speed in directions indicated by arrows and fix the unfixed toner image on the recording material P under heat pressing as a fixed image while nipping and conveying the recording material P in the fixing nip.

The recording material P, coming out of the fixing device 11, on which the toner image is fixed is discharged on an unshown sheet discharge tray as an image-formed material.

The surface of the drum 1 after the recording material P is separated is cleaned at a cleaning portion E by removing therefrom a residual contaminant such as transfer residual toner or paper dust attached to the drum surface by a cleaning device 6 after the separation of the recording material P. In this embodiment, the cleaning device 6 uses an elastic blade 6*a* as a cleaning member. The drum surface is then subjected to whole surface exposure at a pre-exposure portion F by a pre-exposure lamp 7. Residual latent image electric charges on the drum surface are removed to provide a uniform potential, so that the drum surface is subjected to a subsequent image forming operation repetitively.

(2) Charging Bias Generating Portion E2

Figure 2:
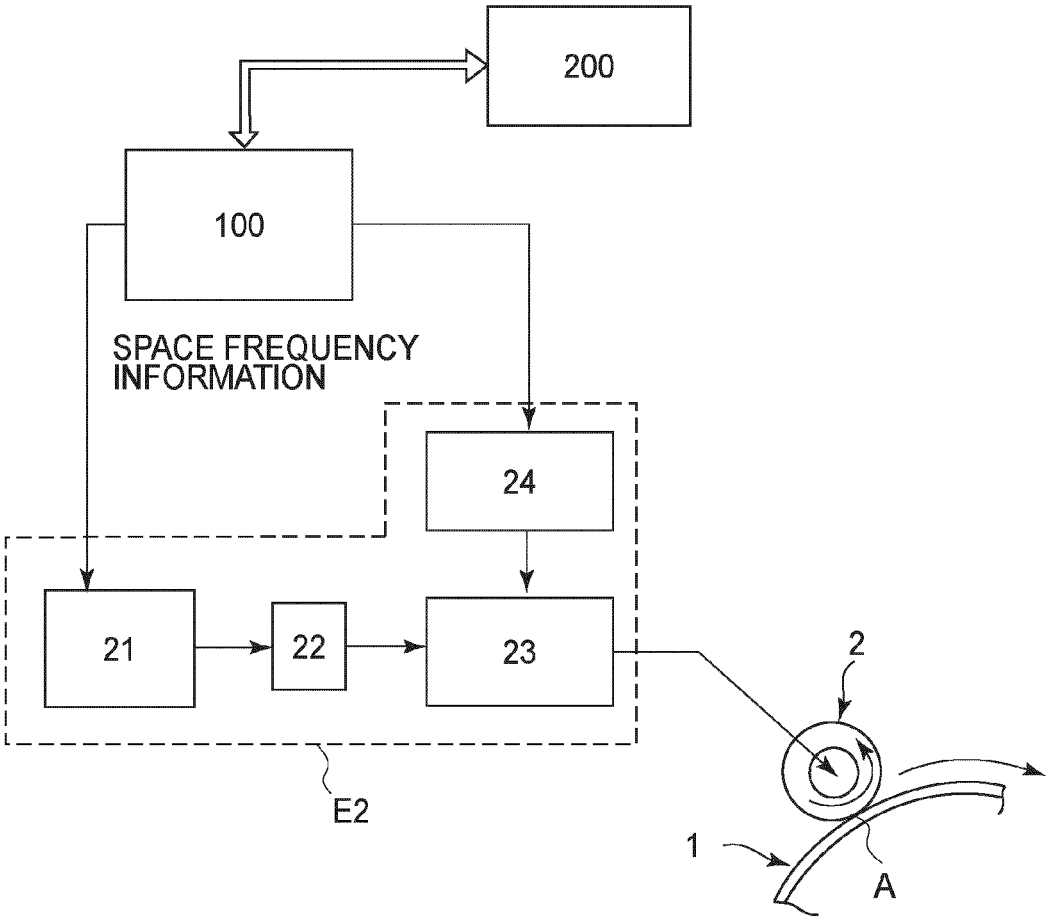
FIG. 2 is a block circuit diagram showing a constitution of a charging bias generating portion.

FIG. 2 is a schematic view showing the charging bias generating portion E2 as a voltage applying means (power source portion) with respect to the charging roller 2.

The charging bias generating portion E2 includes a waveform generating device (CPU) 21, a D/A converter for converting a digital waveform signal generated by the waveform generating device 21 into an analog waveform signal, a high voltage generating portion 23 for generating a desired light voltage signal by multiplying the analog waveform signal generated by the D/A converter 22 by a proportionality factor, and a DC power source control portion 24 for applying a constant voltage(constant component) by stopping oscillation of an AC voltage(AC component).

The waveform generating device 21 is capable of generating any waveform in accordance with a clock frequency of an internal timer. On the basis of spatial frequency information from the main assembly control portion 100, the waveform generating device 21 selects an optimum digital waveform signal and drives the high voltage generating portion 23 through the D/A converter 22.

In the present invention, a wave(form) of the oscillating voltage is not limited to a sinusoidal wave but may also be any wave such as a rectangular wave, a saw-tooth wave, a triangular wave, or a pulse wave.

The high voltage generating portion 23 has a circuit structure optimized so as to output a sinusoidal wave having a frequency of 1.6 kHz and an amplitude of 1.8 kV. As the charging bias, the rectangular wave is also applicable but the use of the sinusoidal wave is advantageous in view of charging noise and damage to the drum 1.

The DC power source control portion 24 is controlled by the main assembly control portion 100 and drives the high voltage generating portion 23 so as to superpose a DC voltage (component) corresponding to a desired drum potential on an AC voltage (component). In this embodiment, a DC voltage of −650 V is outputted and superposed on the AC voltage.

In this embodiment, as the AC voltage, the sinusoidal wave of 1.6 kHz (frequency) and 1.8 kV (amplitude) is sued as a fundamental waveform. Further, an optimum DC voltage application time depending on a spatial frequency in sub-scan direction of an image to be outputted every one period is provided. That is, by changing a blank time (DC application time) between waveform portions depending on a spatial frequency of an image to be outputted while keeping the fundamental frequency of the AC voltage by the main assembly, moire due to interference of an image pattern and the charging bias is prevented.

Figure 3:
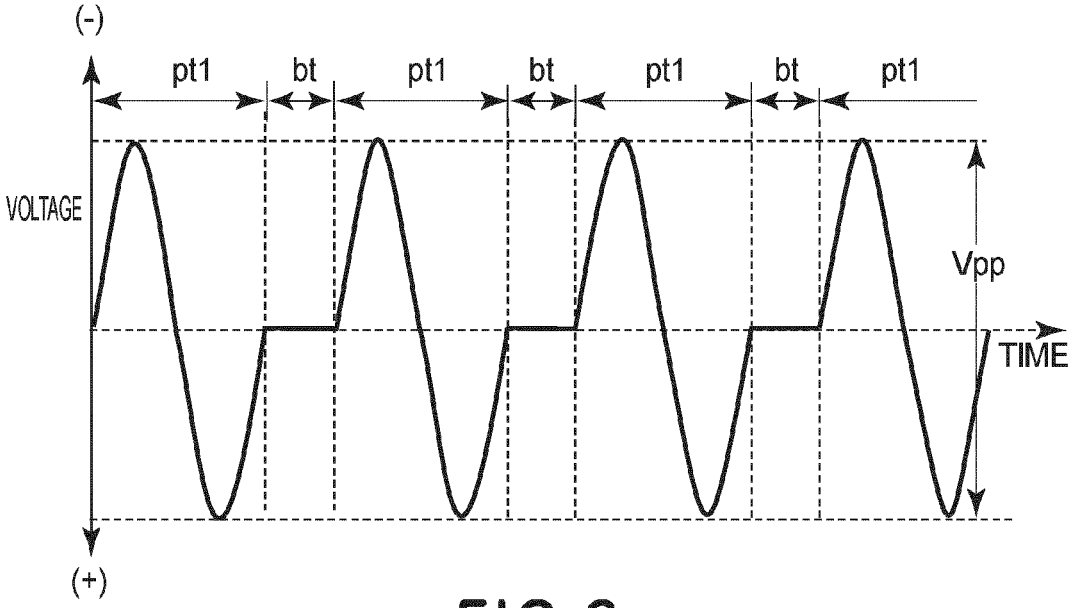
FIG. 3 is a waveform graph of a high voltage source driving signal in Embodiment 1.

A waveform of the driving signal of the high voltage generating portion 23 used in this embodiment is shown in FIG. 3. This waveform is constituted by a time pt for applying the fundamental waveform and a DC voltage application time bt (DC time bt) provided every one period of the fundamental waveform. In this embodiment, when one cycle (one period) is consisting of the time pt (application time of the AC waveform) and the DC time bt (application time of the DC waveform), a time (period) in which application of the AC waveform is stopped is changed depending on the spatial frequency in sub-scan direction. More specifically, the DC time bt is changed depending on the spatial frequency in sub-scan direction of an image to be outputted. Here, the spatial frequency Fd in sub-scan direction in the present invention is the number of repetition of a darkness (bright and dark) pattern per 1 mm. In this embodiment, the AC waveform application stop time is changed depending on the number of screen lines constituting the repetition of the darkness pattern. More specifically, the AC waveform application stop time is changed depending on a spatial frequency in sub-scan direction determined by the number of screen lines.

Figure 7:
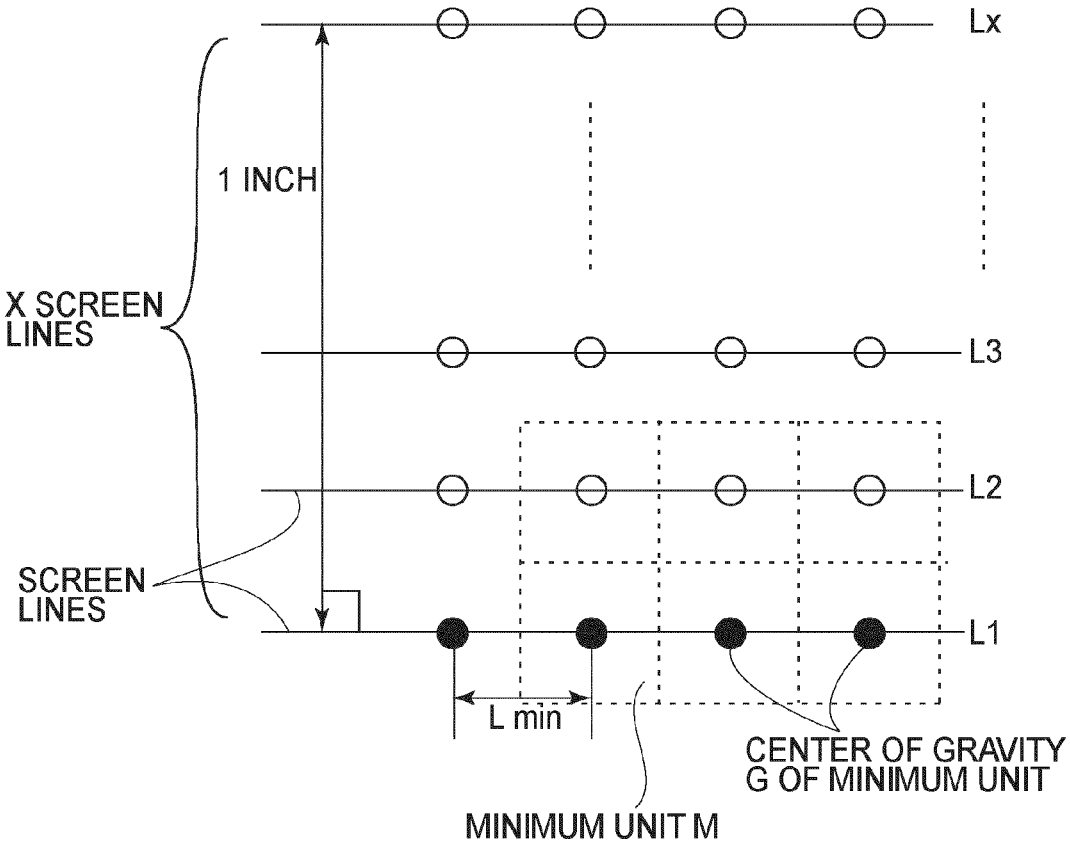
FIG. 7 is a schematic view for illustrating the number of screen lines.

Here, the number of screen lines will be described. FIG. 7 shows a screen pattern having the number of screen lines of X. Of groups of lines passing through centers of gravity G of minimum units M each necessary to reproduce all gradation levels for the image to be formed (e.g., dot assemblies), those of lines passing through the centers of gravity G of the minimum units M with a minimum distance Lmin between adjacent centers of gravity G of minimum units M are considered. The number of the screen lines means the number of screen lines, constituting a screen line group, per inch (LPI: lines or inch) with respect to a direction perpendicular to the extension directions of the screen lines. In the case shown in FIG. 7, in one inch, there are X screen lines (L1, L2, L3, . . . Lx), so that the number of the screen lines (per inch) is X.

When the screen line number is increased, a spatial frequency in the direction perpendicular to the screen lines is also increased. Herein, the extension direction of the screen line, i.e., a direction parallel to the screen lines is referred to as a screen pattern direction (a direction in which a distance between adjacent centers of gravity of minimum units is minimum).

A relationship between the spatial frequency Fd of the image in the sub-scan direction (the rotational direction of the image bearing member) and a pixel density (a resolution of the image forming apparatus) will be described by taken, as an example, a pattern having screen lines with respect to the screen pattern direction as the main scan direction. For example, when the minimum unit necessary to reproduce all the gradation levels is a matrix of t×t, the following equation is satisfied:

$$Fd=25.4/(t\times d)(mm),$$

wherein d represents a width of one dot, i.e., d=25.4/D (mm) where D (dots per inch) represents a pixel density (resolution).

In this embodiment, a screen line number for representing a half-tone level during an image forming operation is set by a user or pre-set in the control portion 100 and, depending on a spatial frequency in sub-scan direction determined by the above set screen line number, the blank time is changed by the control portion 100.

Figure 4:
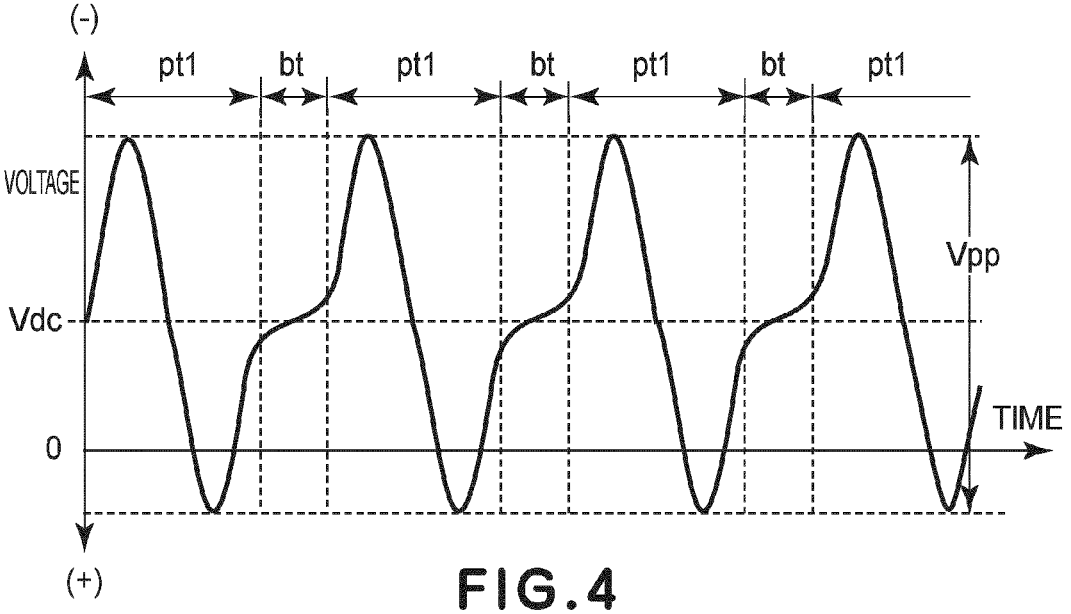
FIG. 4 is a waveform graph of a charging bias outputted to a charging roller in response to the driving signal shown in FIG. 3.

A waveform of a charging bias actually outputted to the charging roller 2 in response to the driving signal shown in FIG. 3 is shown in FIG. 4. Even in the case where the DC time bt is provided, the waveform of the sinusoidal wave causes no disorder and an amplitude thereof is not changed.

In the case where a frequency is changed in a high voltage circuit used in an ordinary image forming apparatus, there can arise problems of a lowering in charging property and an increase in charging noise due to a change in amplitude and disorder of a waveform and a problem of an increase in wearing of a photosensitive member. In this embodiment, the disorder of the waveform and the change in amplitude are not caused to occur, so that the above described problems do not arise.

A state of an occurrence of moire each in the cases where the screen line number and the DC time bt are changed is shown in Table 1.

TABLE 1

| lines/inch | EMB. | COMP. EMB |
|---|---|---|
| 300 | Not occurred | Not occurred |
| 200 | Not occurred | Not occurred |
| 150 | Not occurred | Occurred |
| 120 | Not occurred | Not occurred |

In the Embodiment and the Comparative Embodiment as shown in the above table, a direction of the screen pattern is parallel to the main scan direction and the screen line number (lines/inch) is set to 300, 200, 150, and 120. A potential ripple by the AC bias applied to the charging roller 2 occurs with respect to the sub-scan direction, so that the screen pattern parallel to the main scan direction generates moire most intensity.

In the Comparative Embodiment, the DC time bt is not provided. In the Comparative Embodiment, the screen pattern having the screen line number of 150 (lines/inch) caused darkness non-uniformity due to the occurrence of moire. This is because in the case of electrically charging the drum 1 rotated at a peripheral speed of 250 mm/sec by the charging bias having the frequency of 1.6 kHz, potential ripple due to the charging appears at an interval corresponding to 163 (lines/inch), so that interference between the potential ripple and the image pattern appears as the darkness non-uniformity at a noticeable spatial frequency in the case of the screen line number of 150 (lines/inch) closer to 163 (lines/inch).

In the Embodiment, a DC time bt of 300 μsec was provided as the DC time bt. In the image pattern having the screen line number of 150 (lines/inch), the moire was not substantially noticeable by using this charging bias. This is because a difference between a spatial frequency causing the potential ripple and a spatial frequency of the image pattern is increased by providing the DC toner bt, so that the darkness non-uniformity caused by the interference is less noticeable.

In the Embodiment, the (charging) potential ripple corresponds to the screen line number of about 110 (lines/inch), so that a period of the darkness non-uniformity caused by the interference with the image pattern is 0.6 mm according to calculation, thus resulting in darkness non-uniformity which is little noticeable.

A long DC time bt is capable of largely changing the spatial frequency for the potential ripple, so that the long DC time bt is advantageous from the viewpoint of prevention of the moire but an excessively long DC time can cause a density change due to improper charging. This is because a charge imparting power is extremely low during application of the DC voltage. In this embodiment, a lowering in potential wave observed at a DC time of 500 μsec or longer. This condition varies depending on a charging roller diameter, a drum diameter, a process speed, an amplitude of a charging bias, a fundamental frequency, etc., so that it is necessary to determine a settable range of the DC time bt depending on the respective conditions.

As described above, in this embodiment, the DC time bt is changed depending on an spatial frequency (line number X) of the image to be outputted by providing the DC time bt every one period (cycle) in the AC waveform of the charging bias. As a result, the spatial frequency causing the potential ripple is changed with no disorder of the AC voltage, so that it is possible to prevent the moire due to the interference with the image pattern. Further, it is also possible to prevent beat noise due to interference with a developing AC bias.

In this embodiment, a line number during image formation is determined by the CPU 100 on the basis of image information to be inputted. In this embodiment, image forming modes for forming images with the line numbers (lines/inch) of 300, 200, 150, and 120, respectively are employed, so that the line number X is uniformly determined depending on the image forming mode employed. Further, the CPU 100 is configured to change the blank time to an optimum value depending on each of the line numbers. Further, the line number during image formation may also be settable by an unshown selection button to be pushed by the user.

In this embodiment, description is made by using the screen pattern having the screen lines extending parallel to the main scan direction as the image pattern but the present invention is also applicable to an ordinary screen pattern having screen lines extending with an angle with respect to the main scan direction. For example, the present invention is applicable to the case where the angle and the number of screen lines are different every color station of a tandem-type full-color image forming apparatus. Even in the case where a common high voltage generating circuit is used for the respective color stations, it is also possible to prevent the occurrence of moire by optimizing the DC time bt depending on a spatial frequency of an image to be outputted for each color station.

As described above, the DC voltage at application time is provided for each one period of the AC voltage and is changed depending on the spatial frequency of the image to be outputted, so that a period (cycle) of minute potential non-uniformity caused by charging with the AC voltage is controlled so as not to interfere with the image. As a result, output of a moire image is prevented.

In this embodiment, the charging roller is used as the charging member (means) but other charging members employing brush charging and injection charging are improved in charging uniformity by applying the AC voltage. Further, in a charging method causing minute charging ripple, any charging member is applicable.

Embodiment 2

In Embodiment 2, the DC time bt is randomly changed every one period (cycle) of a charging bias. More specifically, the blank time (DC time bt) between waveform portions is changed while the fundamental frequency of the AC voltage is retained as it is, so that the occurrence of the moire image caused by the interference with the image pattern is prevented.

The constitutions of the image forming apparatus and the charging bias generating portion are similar to those described with reference to FIGS. 3 and 4 in Embodiment 1, so that redundant description will be omitted.

Figure 5:
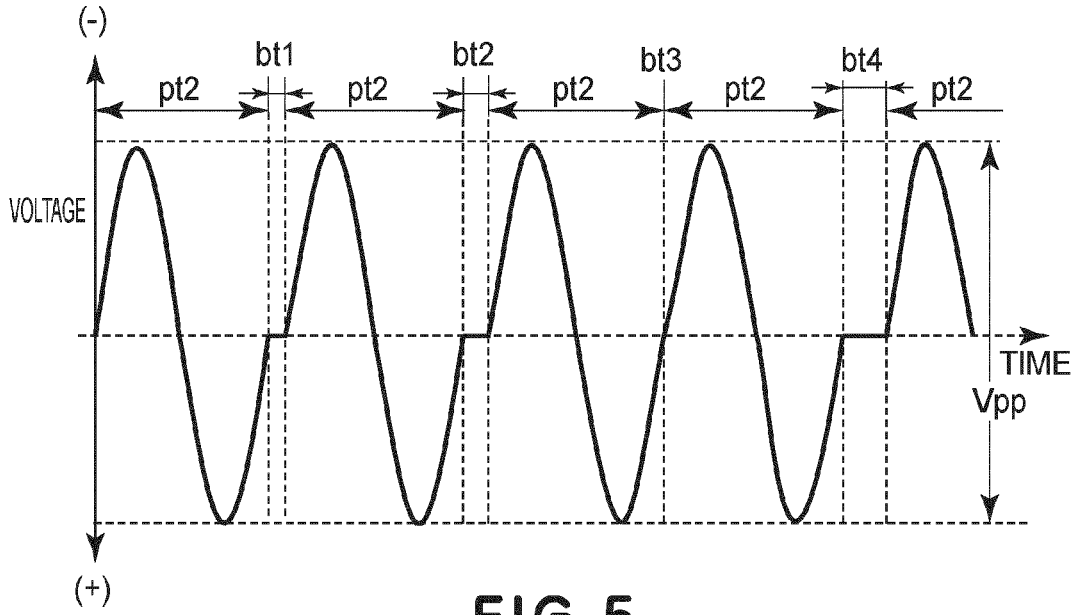
FIG. 5 is a waveform graph of a high voltage source driving signal in Embodiment 2.

A driving signal waveform of the high voltage generating portion 23 is shown in FIG. 5. Referring to FIG. 5, the fundamental waveform of the AC bias is the same as that in Embodiment 1, i.e., a signal for driving the high voltage generating portion 23 with the sinusoidal wave having an amplitude of 1.8 kV and a frequency of 1.6 kHz. Between adjacent fundamental waveform application times pt 2, a DC time bt is provided every one period (cycle). More specifically, DC voltage application times (DC times) bt1, bt2, bt3, bt4, . . . are randomly selected from a range of 0 μsec to 300 μsec. The DC time bt is set one by one by a random number generating portion in the waveform generating device (CPU) 21.

Figure 6:
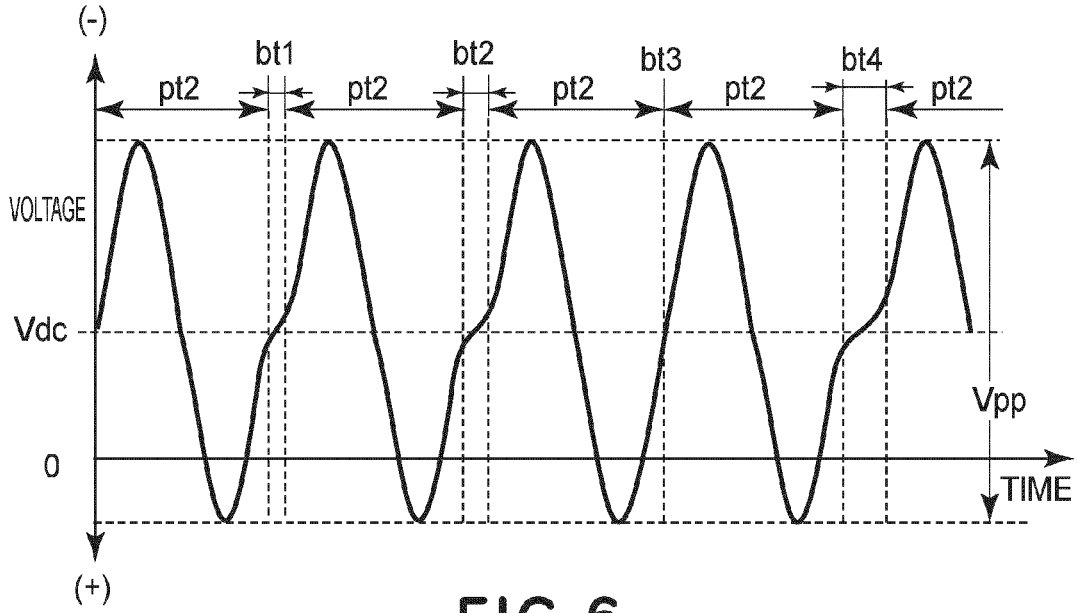
FIG. 6 is a waveform graph of a charging bias outputted to a charging roller in response to the driving signal shown in FIG. 5.

A waveform of a charging bias actually outputted to the charging roller 2 in response to the driving signal is shown in FIG. 6. Even in the case where the DC time bt is randomly changed for each one period as in this embodiment, the waveform shape of the sinusoidal wave is little disordered. In this embodiment, when the drum 1 is electrically charged in the image forming apparatus under the A bias condition described above, the drum 1 had a potential of −650 V converged to a DV bias Vdc.

As described in Embodiment 1, when the DC time bt is excessively long, improper charging can occur.

In this embodiment, when a time range of the DC time bt is set to 0 to 600 μsec, a charging potential is liable to be somewhat unstable. The settable (variable) range of the DC time bt has a poor moire prevention effect when it is excessively narrow and on the other hand, provides an unstable potential as described above when it is excessively side, thus being required to.

By using the charging bias in this embodiment, when screen line images having the screen line numbers (lines/inch) of 300, 200, 150, and 120 were outputted, moire did not appear in all of the image patterns. This is because the DC time bt is set as a random time for each one period, so that the potential ripple has no periodicity, thus causing no interference itself.

According to the method of this embodiment, the moire does not occur in principle, so that even when, e.g., an image having a mixture of image patterns having a plurality of spatial frequencies is formed, the moire does not occur by using the charging bias in this embodiment. Further, beat noise due to the developing AC bias can also be prevented.

As described above, the DC voltage application time is provided every one period of the AC voltage and is irregularly changed, so that periodicity of minute potential non-uniformity by charging is eliminated to prevent a potential interference with the image. As a result, the moire image is prevented from being outputted.

In this embodiment, the charging roller is used as the charging member (means) but other charging members employing brush charging and injection charging are improved in charging uniformity by applying the AC voltage. Further, in a charging method causing minute charging ripple, any charging member is applicable.

Other Embodiments

1) The electrophotographic photosensitive member 1 as the image bearing member is not limited to the drum-type but may also be rotationally driven endless belt-type, a movable web-type, etc. The image bearing member may be an electrostatic recording dielectric member of the drum-type, the endless belt-type, the web-type, etc. The image bearing member may also be photosensitive paper (electrofax paper) or electrostatic recording paper which are conveyed and moved in a direct-type image forming apparatus.

2) The charging means for electrically charging the image bearing member by applying the AC voltage is not limited to the charging roller brought into contact with the image bearing member but may also be other means, brought into contact with the image bearing member, such as electroconductive blade member, rod member, block member, sheet member, fur brush member, and magnetic brush member.

The charging means may also be a contact injection charging means as disclosed in JP-A Hei 6-3921, wherein a voltage is applied to a contact charging member such as a charging roller, a charging brush, or a charging magnetic brush is inject electric charges into electroconductive particles in a charge injection layer formed at a surface of a member to be charged, thus effecting charging.

The charging means as the contact charging means or the contact injection charging means is not necessarily in contact with the member to be charged. For example, the charging means and the member to be charged may also be disposed close to each other with a minute spacing (gap) of, e.g., several tens of μm so long as a dischargeable area determined by a gap voltage and a correction Paschen curve is ensured between the charging means and the member to be charged.

3) The discharging means for selectively discharging the charged surface of the image bearing member to form the electrostatic latent image is not limited to the laser scanner for performing the digital exposure scanning with the light beam but may also be other digital exposure means including a combination of a light source such as an LED array or a fluorescent lamp and a liquid crystal shutter or the like.

In the case where the image bearing member is the electrostatic recording dielectric member, the dielectric member is electrically charged uniformly to a predetermined polarity and a predetermined potential by the contact charging means and the charged surface thereof is selectively discharged by the discharging means such as a discharging needle or an electron gun to form an electrostatic latent image.

4) The developing means 4 is also not particularly limited but may be a reverse developing device or a normal developing device. Generally, a developing method for developing the electrostatic latent image with toner is roughly classified into four methods consisting of a one component non-contact developing method, a one component contact developing method, a two component contact developing method, and a two component non-contact developing method.

The one component non-contact developing method is a method of developing the electrostatic latent image by applying non-magnetic toner onto a developer carrying (conveying) member, such as a sleeve or the like, by a blade or the like or applying magnetic toner onto the developer carrying member by a magnetic force and then by causing the non-magnetic toner or the magnetic toner to act on the image bearing member in a non-contact state.

The one component contact developing method is a method of developing the electrostatic latent image by causing the non-magnetic toner or the magnetic toner applied onto the developer carrying member in the above described manner to act on the image bearing member in a contact state.

The two component contact developing method is a method of developing the electrostatic latent image by conveying a two component developer, including a mixture of toner and a magnetic carrier, by the magnetic force and then causing the two component developer to act on the image bearing member in the contact state.

The two component non-contact developing method is a method of developing the electrostatic latent image by causing the above described two component developer to act on the image bearing member in the non-contact state.

5) The transferring means 5 is not limited to the transferring roller but may also be a transferring belt or a corona transferring means.

6) The cleaning member **6*a*** for the image bearing member is not limited to the blade but may also be any member such as a roller, a brush, or a belt so long as the member can contact the image bearing member and remove a contaminant from the image bearing member.

7) The image forming apparatus is not limited to the printer but may also be copying machine, a facsimile apparatus, a multi-function machine of these machines, etc. The image forming apparatus may be an image forming apparatus capable of forming not only a single-color image but also a multi-color or full-color image in a superposition manner or the like by using an intermediary transfer member such as a transfer drum or a transfer belt.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 312685/2006 filed Nov. 20, 2006, which is hereby incorporated by reference.

What is claimed is:

1. An image forming apparatus comprising:

a rotatable photosensitive member;

a charging member configured and positioned to charge said photosensitive member;

an applying unit configured to apply, to said charging member, a charging bias voltage comprising an oscillating voltage component of a predetermined frequency and a constant voltage component in each cycle;

an exposure unit configured and positioned to form an electrostatic image by exposing said photosensitive member on the basis of image information inputted thereto; and executing means for executing an operation, on the basis of the image information inputted, in a first mode or a second mode selected in accordance with a speed of said photosensitive member and a resolution of an image to be outputted, wherein in the first mode, a duration of the constant voltage component is a first predetermined duration, and in the second mode, the duration of the constant voltage component is a second predetermined duration which is different from the first predetermined duration.

2. The apparatus according to claim 1, wherein the oscillating voltage component of the predetermined frequency is in the form of a one cycle of a sinusoidal wave.

3. The image forming apparatus according to claim 1, wherein the predetermined frequency of the oscillating voltage component applied to said charging member in the first mode is equal to the predetermined frequency of the oscillating voltage component applied to said charging member in the second mode.

* * * * *